United States Patent [19]

McCall

[11] 4,434,599

[45] Mar. 6, 1984

[54] DROP CEILING FRAME CONSTRUCTION

[75] Inventor: Francis L. McCall, Hacienda Heights, Calif.

[73] Assignee: Specified Ceiling Systems, Alhambra, Calif.

[21] Appl. No.: 363,603

[22] Filed: Mar. 30, 1982

[51] Int. Cl.[3] ..... E04B 5/52; E04C 3/30

[52] U.S. Cl. ..... 52/729; 52/484

[58] Field of Search ..... 52/729–731, 52/484–489

[56] References Cited

U.S. PATENT DOCUMENTS

| | | | |
|---|---|---|---|
| 3,189,139 | 6/1965 | Znamirowski | 52/729 X |
| 3,214,875 | 11/1965 | Slowinski et al. | 52/729 X |
| 3,487,518 | 1/1970 | Hopfeld | 52/729 X |
| 3,843,086 | 10/1974 | Ptak | 52/484 |
| 4,133,155 | 1/1979 | Oelrich | 52/729 X |
| 4,156,999 | 6/1979 | Avery | 52/731 X |
| 4,206,578 | 6/1980 | Mieyal | 52/730 |

FOREIGN PATENT DOCUMENTS

| | | | |
|---|---|---|---|
| 561505 | 5/1944 | United Kingdom | 52/729 |

*Primary Examiner*—J. Karl Bell

*Attorney, Agent, or Firm*—Christie, Parker & Hale

[57] ABSTRACT

A T-frame member for a drop ceiling, made of rolled sheet metal, in which a web section is joined to a pair of coplanar flange members by a connecting channel section, the flange sections being joined to and extending outwardly from the respective outer edges of the two channel side walls. The inner edges of the flanges form lips projecting toward each other between the side walls. Partition studs having a collar slightly larger than the space between the lips are snapped into the channel sections and are retained by the collar, the studs projecting out through the space between the lips. Clips lock the flanges together after the studs are in place.

3 Claims, 3 Drawing Figures

DROP CEILING FRAME CONSTRUCTION

FIELD OF THE INVENTION

This invention relates to drop ceiling construction, and more specifically, to a roll formed runner for a drop ceiling frame.

BACKGROUND OF THE INVENTION

Drop ceiling construction has become popular in office building design for a number of reasons. The drop ceiling provides an architecturally pleasing appearance and provides a space between the drop ceiling and the structural ceiling for heating and air conditioning ducts, plumbing, wiring and the like. The drop ceiling is constructed from a metal frame in the form of a matrix of runners which are generally of extruded or roll formed metal. The frame is used to support acoustic tile panels and light fixtures. An example of a drop ceiling framework of rolled sheet metal construction is described in U.S. Pat. No. 4,135,441.

SUMMARY OF THE INVENTION

The present invention is directed to an improved drop ceiling frame construction which can be roll formed of sheet metal. The frame has a pleasing appearance architecturally and at the same time provides a strong frame for supporting the ceiling and for securing partitions. A unique slot arrangement forms a reveal and also provides a means of attaching partitions to the underside of the frame at any point along the length of a runner forming the frame.

This is accomplished, in brief, by providing a T-frame member for a drop ceiling made of rolled sheet metal formed into a web section which is joined to a pair of coplanar flange members by a connecting channel-shaped section, the flange sections being joined to and extending outwardly from the respective outer edges of the two side walls of the channel section. The inner edges of the flanges form lips projecting toward each other between the side walls of the channel section, each lip terminating in an edge extending inwardly toward the bottom wall of the channel. A threaded stud has a flattened end with projecting shoulders that is inserted between the lips into the channel by springing the lips apart slightly to allow the shoulders to pass, the shoulders being engaged by the inwardly extending edges of the lips to prevent withdrawal of the stud from between the lips. The threaded end of the stud, projecting away from the frame member, is used to anchor the frame to a wall partition or other structure.

DESCRIPTION OF THE DRAWINGS

For a better understanding of the invention, reference should be made to the accompanying drawings, wherein.

DETAILED DESCRIPTION

Figure 1:
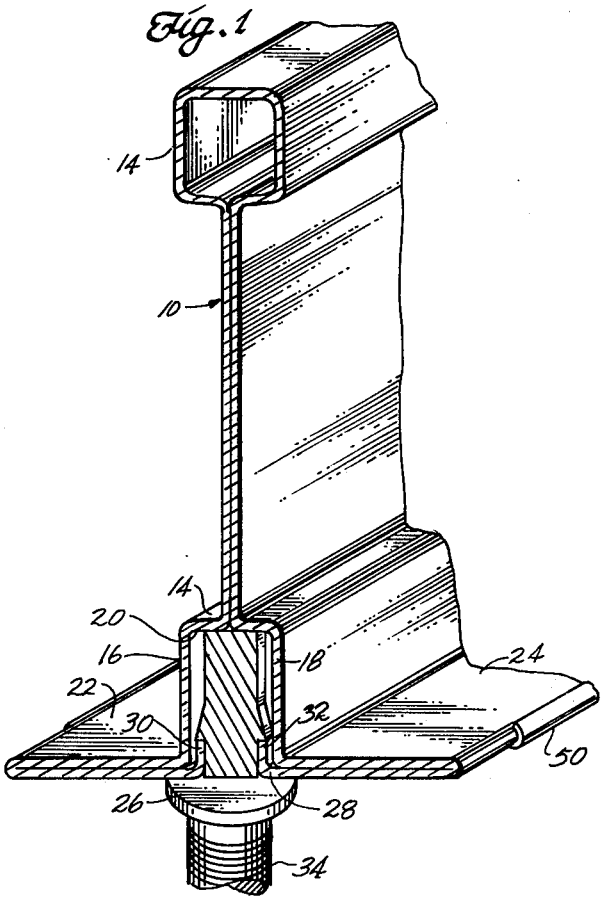
FIG. 1 is an isometric view of a T-runner for a drop ceiling frame.

Referring to FIG. 1 in detail, the numeral 10 indicates generally a T-runner which may be used as part of a drop ceiling framework. The runner is roll formed from a single longitudinal strip of sheet metal material, such as aluminum or steel. The runners can be roll formed into any desired length by conventional roll forming techniques.

The sheet metal is formed to provide a web section 12 consisting of two layers of the sheet metal normally lying in intimate contact. The upper edge of the web section is formed into a box frame section 14 which strengthens the upper edge of the web section against lateral bending. The box section 14 is formed by folding the sheet metal to bring the sheet metal back together to form the two layers of the web section 12.

At the lower edge of the web section 12, the sheet metal layers are bent outwardly and then downwardly to form a channel-shaped section 14, the channel section including a pair of parallel side walls 16 and 18 and a bottom wall 20. The outer edges of the side walls 16 and 18 are formed by folding the sheet metal outwardly to form a pair of coplanar flange sections 22 and 24. The flange sections constitute the cross portion of the T-shaped frame member. The flange sections are formed of two layers of sheet metal by folding the sheet metal over along the outer edges of the flange sections. One sheet metal layer of the flanges projects into the space between the side walls 16 and 18 to form lips 26 and 28, each lip terminating in an edge, indicated at 30 and 32, respectively, extending inwardly toward the bottom wall of the channel. Thus the lips narrow the longitudinal opening into the channel. This opening forms a reveal which gives the drop ceiling framework an architecturally pleasing appearance. Preferably the inside surface of the sheet metal is coated with a black finish before the sheet metal rolling operation so that the interior of the channel section is not light reflective. This enhances the effect of the reveal.

Figure 2:
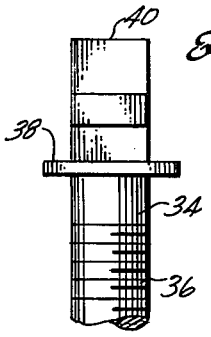
FIG. 2 is a side view of a stud used with the runner.
Figure 3:
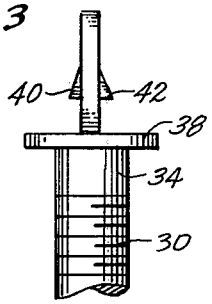
FIG. 3 is an edge view of the stud.

In addition to the aesthetic effect, the channel section and projecting lips 26 and 28 are functionally important in providing a means of anchoring wall partitions and other structures to the drop ceiling frame members. This is accomplished by a special stud 34, shown in detail in FIGS. 2 and 3. The stud includes a threaded shank 36 which terminates in a collar or flange 38. The head 40 of the stud above the collar 38 is necked down to provide a flat blade. The flat wide surfaces of the blade-shaped head 40 are formed with projections 41 and 42 on either side to provide shoulders spaced from the collar 38. The thickness of the blade section of the stud head 40 is equal to or slightly smaller than the space between the lips 26 and 28, allowing the head 40 to be inserted into the channel section 16 of the runner. The projections 40 and 42 act to wedge the side walls 16 and 18 apart when they engage the lips 26 and 28. Thus the projections 40 and 42 can be forced through the space between the inner ends 30 and 32 of the lips. Once the shoulders clear the inner edges 30 and 32, the lips spring together and engage the blade and shoulders of the stud head to retain the stud in the channel section. It will be noted that the sheet metal layers forming the web section 12 and the sheet metal walls of the block section 14 are sufficiently flexible and springy to permit the lips 26 and 28 to be wedged apart by the projections 40 and 42 when the stud head is inserted into the channel section.

Once a stud is inserted at any point along the length of the channel section, a suitable clip 50 is attached, the clip spanning the two flange sections 22 and 24 and having spring fingers at either end of the clip which snap over the outer edge of the flange sections. The clip prevents the flange sections and associated lips from spreading apart and thus prevents the stud from being pulled out.

What is claimed is:

1. A rolled sheet metal longitudinal T-frame member for a drop ceiling to support ceiling tiles or the like comprising:

a web section formed of two sheet metal layers joined along a longitudinal edge, a channel section having two parallel side walls joined by a transverse wall, the sheet metal layers of web section being joined along a longitudinal edge to the side walls of the channel section by respective sheet metal sections forming the transverse wall, the side walls of the channel section extending parallel to and away from the web section, a pair of flange sections lying in a common plane extending perpendicular to the plane of the web section, each flange section being formed of two layers of sheet metal joined along the outer edge of the flange section, one layer of each flange section being joined along one longitudinal edge to the outer edge of a respective one of the side walls of the channel section, the flange sections projecting outwardly away from the respective side walls and forming a flat supporting surface on either side of the channel section for supporting ceiling tiles, the other layer of each of the flange sections including a lip extending into the space between the parallel side walls of the channel section, each lip terminating in an edge extending inwardly toward the transverse wall of the channel, the lips having a gap between the inwardly extending edges.

2. The T-frame member of claim 1 further including:

at least one threaded stud having projecting shoulders near one end, said one end of the stud being inserted into the gap between the lips into the channel by springing the lips apart slightly to allow the shoulders to pass, the shoulders being engaged by the inwardly extending edges of the lips to prevent withdrawal of the stud from between the lips.

3. The T-frame member of claim 1 further including:

a clip member spanning the flange sections and engaging the outer edges of the flange sections, the clip securing the flange sections and lips from moving apart and releasing the stud.

* * * * *